US006382813B1

(12) United States Patent
Huang

(10) Patent No.: US 6,382,813 B1
(45) Date of Patent: May 7, 2002

(54) STRUCTURE OF A CHRISTMAS LAMP DECORATION

(76) Inventor: Shun-Feng Huang, P.O. Box 697, Feng-Yuan City 420 (TW)

( * ) Notice: Subject to any disclaimer, the term of this patent is extended or adjusted under 35 U.S.C. 154(b) by 0 days.

(21) Appl. No.: 09/860,079

(22) Filed: May 15, 2001

(51) Int. Cl.[7] ..... F21V 21/00
(52) U.S. Cl. ..... 362/249; 362/391; 362/806
(58) Field of Search ..... 362/123, 226, 362/249, 252, 391, 806, 396

(56) References Cited

U.S. PATENT DOCUMENTS 5,697,698 A * 12/1997 Huang ..... 362/226
5,908,238 A * 6/1999 Huang ..... 362/391
5,915,826 A * 6/1999 Lin ..... 362/806
6,048,076 A * 4/2000 Lin ..... 362/249

* cited by examiner

*Primary Examiner*—Y. My Quach-Lee

(57) ABSTRACT

An improved structure of a Christmas lamp decoration comprising a bulblet socket, a bulblet casing and a bulblet stand. A bulbet is inserted into the bulblet socket which has a ring part and flat part, a bar is disposed outside the ring part. The bulbet casing is formed by two semi-circular bodies and is hollow for insertion of the flat part of the bulblet socket. A locking bar and an ear are disposed on two opposite sides as well as an insertion recess on the other two opposite sides of the bulblet casing, the insertion recess if for positioning copper plate of wire. The bulblet stand is hollow for insertion of the bulblet casing, two indentations are disposed on two opposite sides on the circumference of the bulblet stand. Accordingly, insert the locking bar of the bulblet casing into the indentation of the bulblet stand and the ear is exposed outside the bulblet stand, the bar of the bulblet socket is also inserted into the indentation of the bulblet stand for firmer assembly structure.

1 Claim, 3 Drawing Sheets

STRUCTURE OF A CHRISTMAS LAMP DECORATION

BACKGROUND OF THE INVENTION

The present invention relates to a Christmas lamp decoration, more particularly relates to an improved structure of a Christmas lamp decoration. The conventional Christmas lamp decoration can be in series or in net-shape. A prior art with U.S. Pat. No. 5,669,707 titled Christmas Lamp Socket has ears extended from bulblet stand to position wires. The present invention provides a bulblet casing with ears and locking device to be firmly connected to the bulblet stand. An improved structure of a Christmas lamp decoration comprising a bulblet socket, a bulblet casing and a bulblet stand. A bulblet is inserted into the bulblet socket which has a ring part and a flat part, filaments of the bulblet go through the bulblet socket and expose outside. The bulblet casing is formed by two semi-cylindrical bodies and is for insertion of the flat part of the bulblet socket, stopping bars and insertion recesses are disposed at the top opening of the bulblet casing which the insertion recesses are for insertion of a copper plate of a wire. The bulblet stand is in hollow cylindrical shape for insertion of the bulblet casing. Bars in vertical position are disposed on the surface of the ring part of the bulblet socket. Locking bars are located on the sides of the bulblet casing and ears are extended from the locking bars for positioning of the wires. An indentation in vertical positioning is disposed at the bulblet stand in corresponding to the locking bar of the bulblet casing. Accordingly, the locking bar of the bulblet casing is inserted into the indentation of the bulblet stand, so that the ears of the bulblet casing are disposed outside the bulblet stand. The bar of the bulblet socket is also inserted into the indentation of the bulblet stand. The objective of a firmer assembly is thus achieved by the above mentioned structure.

SUMMARY OF THE PRESENT INVENTION

The main objective of the present invention is to provide an improved structure of a lamp decoration for firm and stable assembly and positioning of wires connecting the net-shaped Christmas bulblets.

The present invention will become more fully understood by reference to the following detailed description thereof when read in conjunction with the attached drawings.

DETAILED DESCRIPTION OF THE PREFERRED EMBODIMENT

Figure 1:
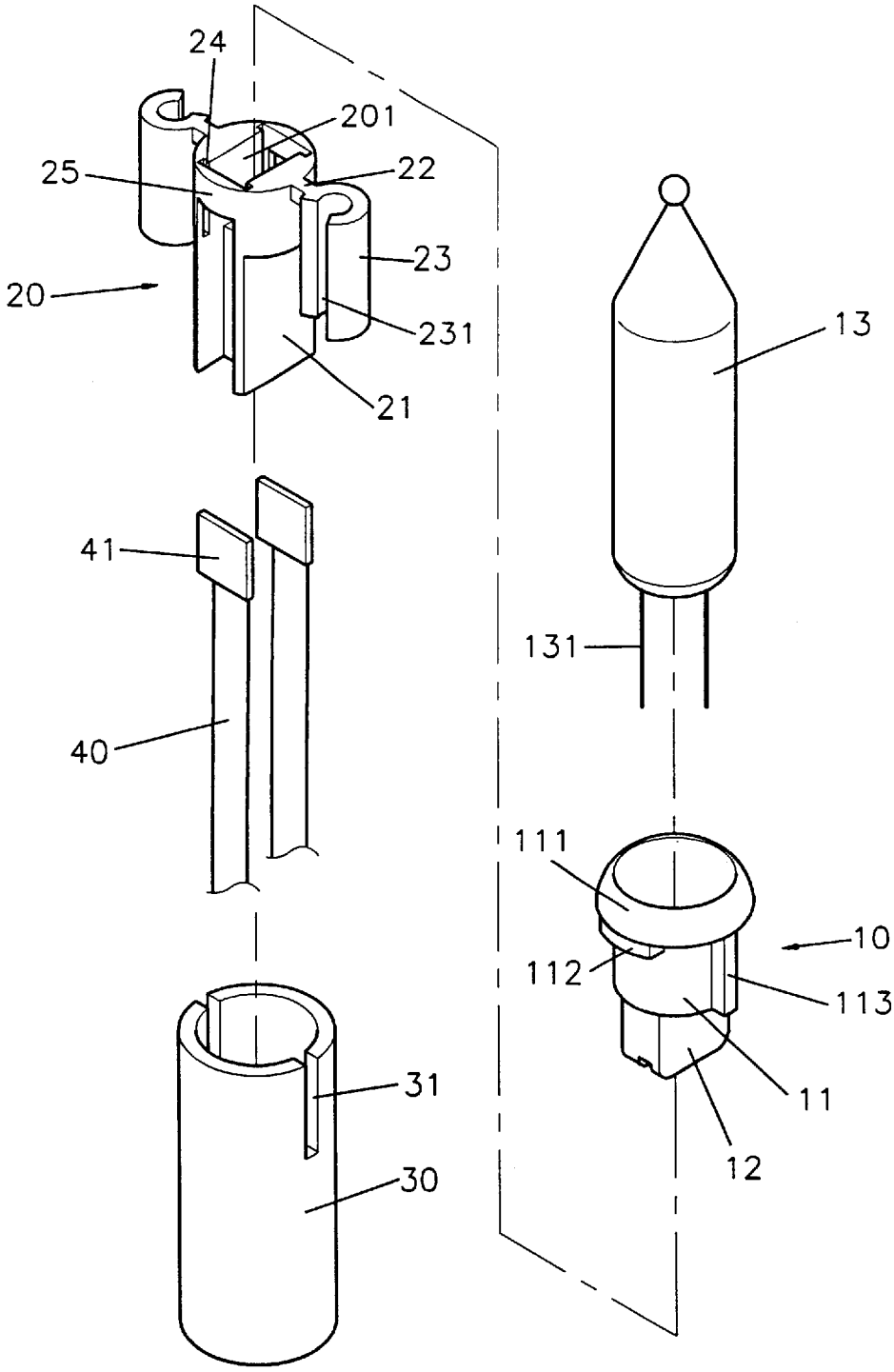
FIG. 1 is a perspective exploded view of the present invention.

Referring to FIG. 1, the present invention comprising a bulblet socket 10, a bulblet casing 20 and a bulblet stand 30. The bulblet socket 10 has a ring part 11 and a flat part 12, a convex ring 111 and a stopping block 112 a located on top of the ring part 11, a bar 113 is disposed on the surface of the ring part 11. Inside of the ring part 11 and the flat part 12 are hollow for a bulblet 13 to be inserted into the bulblet socket 10, a filament 131 extended from the bottom of the bulblet 13 goes through inside the flat part 12 and is exposed outside. The bulblet casing 20 is formed by two semi-circular bodies 21, the inside of the bulblet casing 20 is hollow for enclosing the flat part 12 of the bulblet socket 10. The semi-circular body 21 has a locking bar 22 and an ear 23, a trough 231 is located on the inner curved surface of the ear 23. An insertion recess 24 on the inner side of the semi-circular body 21 is for positioning a copper plate 41 of a wire 40. A stopping bar 25 by the insertion recess 24 is for preventing the copper plate 41 from leaving the insertion recess 24. The bulblet stand 30 is in cylindrical hollow shape and has an indentation 31.

Figure 2:
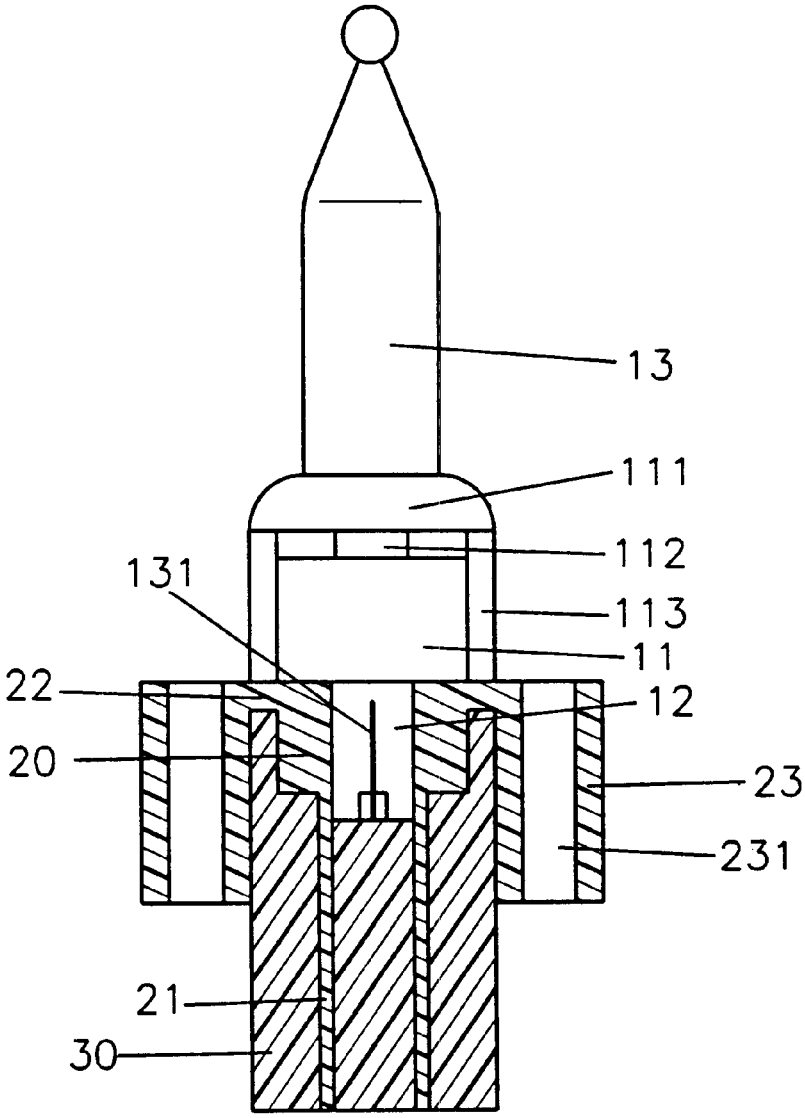
FIG. 2 is a sectional view of the present invention.
Figure 3:
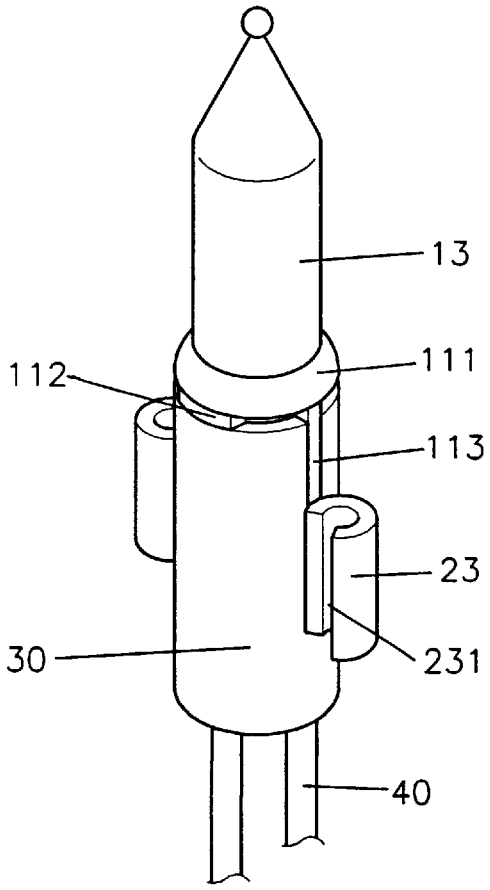
FIG. 3 is a perspective assembled view of the present invention.
Figure 4:
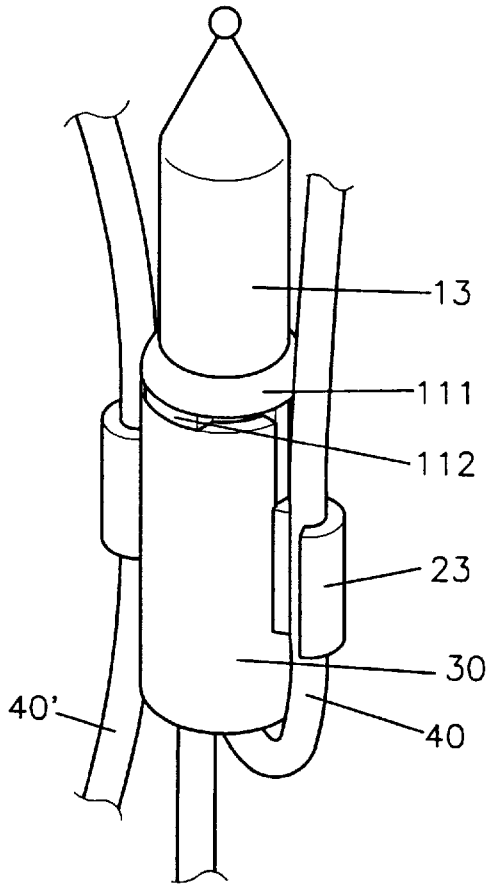
FIG. 4 is a perspective assembled view of the present invention with wires being positioned by the ears.

Referring to FIGS. 1, 2 and 3, insert the bulblet 13 into the bulblet socket 10, let the filament 131 exposes from the bottom of the bulblet socket 10 and bends outwardly. Insert the copper plate 41 of the wire 40 into the insertion recess 24 of the bulblet casing 20, put the flat part 12 of the bulblet socket 10 into a hollow space 201 of the bulblet casing 20, then insert the bulblet casing 20 together with the bulblet socket 10 into the bulblet stand 30, lock the locking bar 22 of the bulblet casing 20 into the indentation 31 as well as the bar 113 of the bulblet socket 10 into the upper part of the indentation 31 until the stopping block 112 of the bulblet socket 10 reaches the top of the bulblet stand 30. So that the ear 23 of the bulblet casing 20 is exposed on the outside circumference of the bulblet stand 30. Referring to FIG. 4, the ear 23 is for positioning the wire 40. Accordingly, the structure of the ear 23, the locking bar 22, the bar 113 and the indentation 31 provides a very firm assembly function.

The specification relating to the above embodiment should be construed as exemplary rather than as limitative of the present invention, with many variations and modifications being readily attainable by a person of average skill in the art without departing from the spirit or scope thereof as defined by the appended claims and their legal equivalents.

I claim:

1. A Christmas lamp decoration comprising: a bulblet socket having a bar formed on an outside of said bulblet socket, said bar disposed parallel to a vertical position of said bulblet socket, a bulblet inserted into said bulblet socket, a filament of said bulblet passing through said bulblet socket and exposed outside of said bulblet socket, said bulblet socket having a ring part and a flat part, a bulblet casing having a plurality of locking bars formed on two opposite sides of said bulblet casing, an ear extended from each of said locking bars for positioning an electrical wire, said bulblet casing formed by two semi-circular bodies for insertion of said flat part, a bulblet stand having an indentation in corresponding to each of said locking bars of said bulblet casing, said indentation disposed parallel to a vertical position of said bulblet stand, said bulblet stand having a hollow interior, said bulblet casing inserted into said bulblet stand, said locking bar of said bulblet casing inserted into said indentation of said bulblet stand with said ear exposed outside of said bullet stand, said bar of said bullet socket also inserted into said indentation of said bulblet stand with a stopping bar of said bulblet socket disposed on top of said bulblet stand, and an insertion recess in each of said semi-circular bodies located adjacent to said stopping bar for positioning a copper plate of said wire.

* * * * *